United States Patent [19]

Giaccaglia

[11] 4,222,185

[45] Sep. 16, 1980

[54] PLASTIC SHOE SOLE FOR SANDALS AND THE LIKE

[76] Inventor: Nello Giaccaglia, Via Matteotti 123, Castelfidardo, Italy

[21] Appl. No.: 27,067

[22] Filed: Apr. 4, 1979

[51] Int. Cl.[3] ..... A43B 13/12; A43B 13/16; A43B 7/06; A43B 3/12

[52] U.S. Cl. ..... 36/30 R; 36/3 B; 36/11.5

[58] Field of Search ..... 36/30 R, 11.5, 3 R, 36/3 B

[56] References Cited

U.S. PATENT DOCUMENTS

| | | | |
|---|---|---|---|
| 945,698 | 1/1910 | Conway | 36/3 B |
| 2,844,833 | 7/1958 | Odermatt | 36/3 B |
| 3,280,484 | 10/1966 | Sensi | 36/3 R |
| 3,418,731 | 12/1968 | Anciaux | 36/30 R |
| 3,742,625 | 7/1973 | Famolare, Jr. | 36/11.5 |

FOREIGN PATENT DOCUMENTS

| | | | |
|---|---|---|---|
| 2250266 | 5/1975 | France | 36/30 R |
| 2285092 | 4/1976 | France | 36/11.5 |

*Primary Examiner*—James Kee Chi
*Attorney, Agent, or Firm*—Karl F. Ross

[57] ABSTRACT

A shoe sole, especially for summer footwear such as sandals, comprises an outsole and an insole of substantially identical outline molded from plastic material. The outsole is provided along its periphery with a set of solid upstanding studs, molded integral therewith, which have reduced tips received in bores of the insole and form shoulders abutting the latter whereby the two sole members are spacedly interconnected. The insole has an array of venting apertures between which it is provided with depending pins over the major part of its area that act as supplemental spacers by coming to rest on the outsole. Other peripheral formations on the outsole, in the shape of flat tubes, enter complementary slots of the insole to form channels for the passage of straps.

7 Claims, 9 Drawing Figures

PLASTIC SHOE SOLE FOR SANDALS AND THE LIKE

FIELD OF THE INVENTION

My present invention relates to a shoe sole, especially for summer footwear such as sandals, beach shoes or the like, of the type wherein two members of substantially identical outline—referred to hereinafter as an insole and an outsole—are spacedly superposed to form a clearance through which air may circulate around the foot of the wearer by way of apertures in the insole.

BACKGROUND OF THE INVENTION

A shoe sole of this type has been disclosed, for example, in U.S. Pat. No. 3,280,484. According to that patent, the two sole members are interconnected by an array of tubular studs rising from the periphery of the outsole and surrounding respective pins integral with the insole. The insole and outsole members may be made from plastic material.

OBJECTS OF THE INVENTION

The general object of my present invention is to provide an improved shoe sole of this type which, besides facilitating the circulation of air to reduce perspiration, gives a firm but elastic support to the foot of the wearer.

Another object is to provide a composite shoe sole of this character which is easy to manufacture and assemble.

SUMMARY OF THE INVENTION

In accordance with my present invention, one of the two sole members—preferably the outsole—is provided along its periphery with a set of solid, substantially vertical studs having reduced tips surrounded by annular shoulders, these tips penetrating a set of bores in the other sole member which comes to rest on the shoulders of the studs whereby the two members are positively interconnected with formation of an air space therebetween. The insole is provided inside a peripheral zone thereof with an array of venting apertures communicating with that air space, as known per se, and is further provided with a multiplicity of pins between these apertures which extend toward the outsole to act as supplemental spacers.

The shouldered, solid studs are easily molded integral with the corresponding sole member and firmly hold the two members together along their peripheries, especially after adhesive bonding. For a still more positive fit, the bores may be stepped in a manner complementary to that of the studs so as to form small-diameter sections occupied by the tips and large-diameter sections occupied by adjoining unreduced stud portions.

According to another feature of my invention, the pins projecting downwardly from the insole have substantially the same length as the exposed parts of the studs near the peripheral zone of the insole but are somewhat shorter on an area remote from this zone so that, during walking, the wearer exerts a certain pumping action upon the air cushion present in the space between the two sole members to promote circulation.

BRIEF DESCRIPTION OF THE DRAWING

The above and other features of my invention will now be described in detail with reference to the accompanying drawing in which.

SPECIFIC DESCRIPTION

Figure 1:
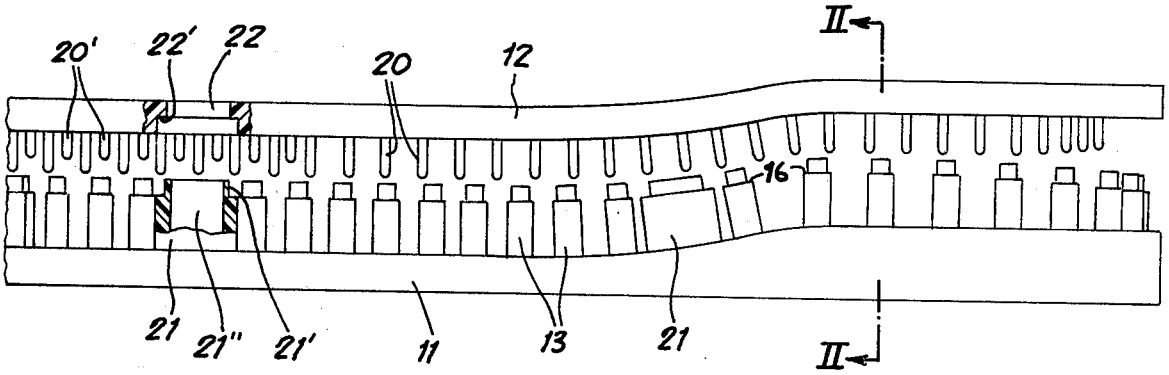
FIG. 1 is a side-elevational view, partly in section, of a shoe sole according to my invention prior to assembly of its members.

The composite shoe sole shown in the drawing comprises a lower member or outsole 11 and an upper member or insole 12 molded from plastic material. A multiplicity of generally cylindrical studs 13 rise integrally from outsole 11 along its entire periphery and engage in confronting bores 14 of insole 12. Each stud 13, has best seen in FIGS. 2 and 4, has a solid body with a reduced tip 15 surrounded by an annular shoulder 16 which, in the embodiment of FIGS. 1–6, comes to rest against an annular seat 17 of the corresponding bore 14 formed betwen a small-diameter portion 14' and a large-diameter portion 14'' thereof. In the assembled position of FIGS. 3–6, the tips 15 pass completely through the bore portion 14' so as to lie flush with the upper surface of insole 12. The insole need therefore not be made any heavier than is necessary for a firm engagement with the upper ends of the studs to which it is glued or cemented after assembly. When the two sole members are of different color, the tips 15 appear to the user as an esthetically pleasing pattern of contrasting dots which, moreover, clearly shows up any irreularity such as a beginning detachment of a stud from the insole, thereby enabling prompt correction of the defect.

The bores 14 lie in a peripheral zone of the insole 12, bounded by a line 18, which surrounds an area provided with an array of throughgoing apertures 19 communicating with the air space that separates the two sole members 11 and 12. Between these apertures I provide a multiplicity of pins 20 which integrally depend from the insole 12 to prevent the collapse of that air space. The pins 20 close to the boundary 18 are of a length corresponding to that of the exposed part of studs 13, i.e. the part not received in bores 14; the more inwardly located pins, designated 20', are somewhat shorter and in the unloaded state of the insole 12 stand clear of the outsole 11 on account of the inherent elasticity of the plastic material. In use, therefore, the central part of the insole forwardly of the heel will oscillate and create a breathing effect which promotes the flow of cooling air through the venting apertures 19.

Figure 3:
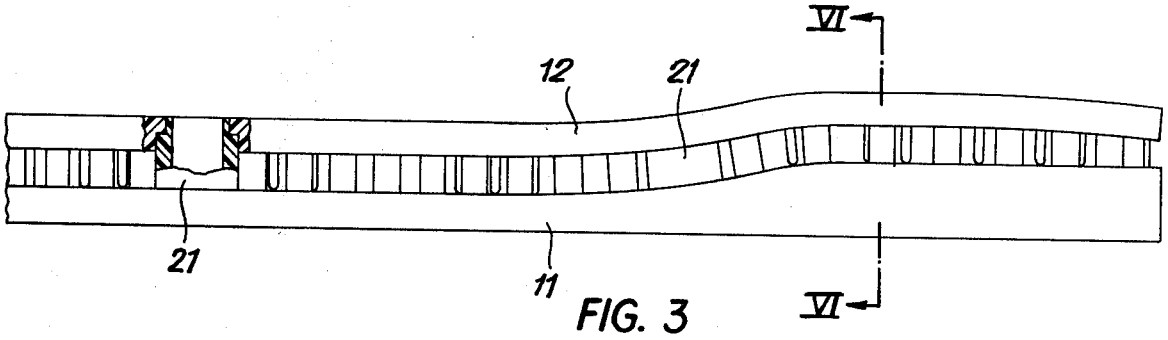
FIG. 3 is a view similar to that of FIG. 1 but showing the two sole members in their assembled position.
Figure 2:
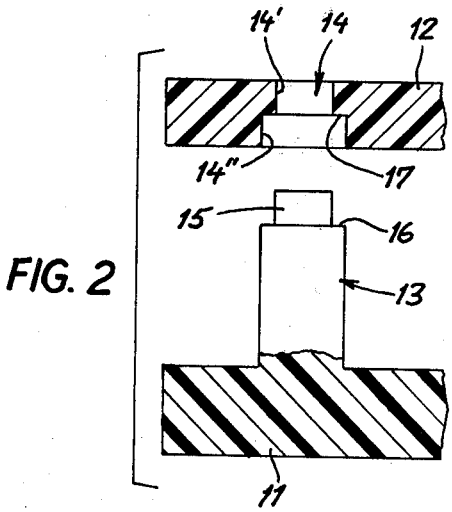
FIG. 2 is a fragmentary cross-sectional view, drawn to a larger scale, taken on the line II—II of FIG. 1.
Figure 4:
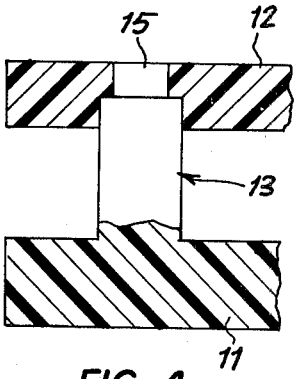
FIG. 4 is a fragmentary cross-sectional view taken on the line IV—IV of FIG. 3 and drawn to the scale of FIG. 2.

In the region of the heel, the peripheral studs 13 and the pins 20 may be a little shorter than in the forward part, as indicated in FIGS. 1 and 3. No staggering of the pin lengths is necessary in that heel portion.

The studs 13 need not be exactly vertical, especially in the region of the instep where the upper face of the outsole 11 has a slope and the studs extend approximately perpendicularly to that slope.

Figure 5:
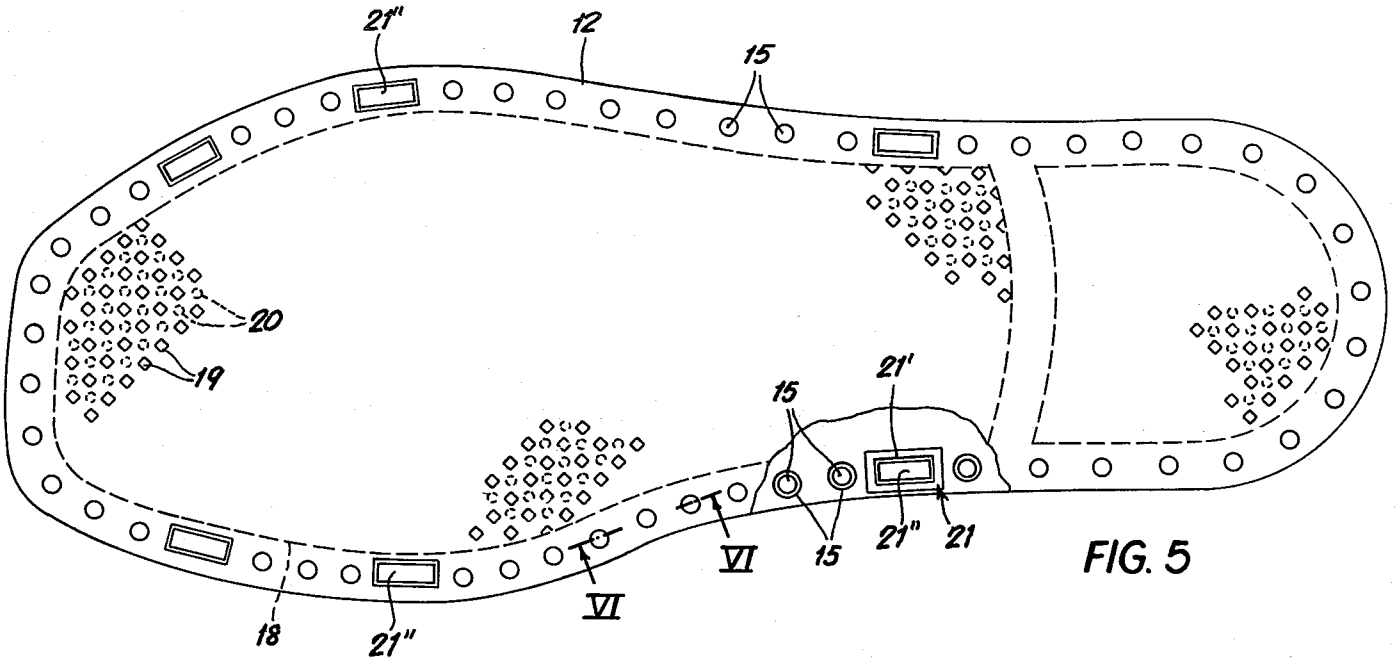
FIG. 5 is a top view of the assembled shoe sole shown in FIG. 3, with parts of the insole broken away to expose the underlying outsole.

As further shown in FIGS. 1, 3 and 5, outsole 11 is provided in its peripheral zone with a few rising formations 21 interleaved with the studs 13, these formations being of flattened tubular shape and being stepped at the level of the shoulders 16 of the adjacent studs to form shoulders 21' which abut confronting shoulders 22' of corresponding slots 22 in insole 12. The coaction of shoulders 21' and 22' supplements that of shoulders 16 and 17 to form an additional support for the insole. The interior of each formation 21 constitutes a narrow channel 21'' serving for the passage of a sandal strap or the like which forms part of the shoe upper.

Figure 7:
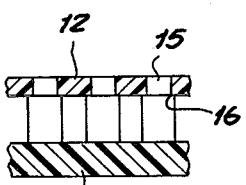
Figure 6:
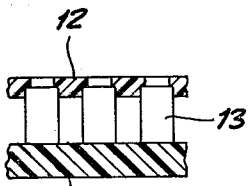
FIG. 6 is a fragmentary cross-sectional view taken on the line VI—VI of FIG. 5 and drawn to a larger scale.

In FIG. 7 I have illustrated a simplified embodiment of my invention in which the bores of the insole 12 are not stepped so that the shoulders 16 of studs 13 are flush with the undersurface of the insole. The tips of the studs are longer than in the preceding instance so as still to be flush with the upper insole face.

Figure 9:
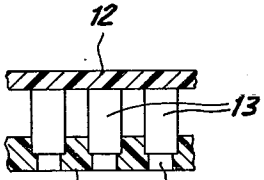
FIGS. 7–9 are views similar to FIG. 6, showing various modifications.
Figure 8:
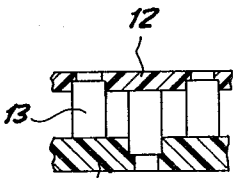

As shown in FIG. 8, studs 13 may be integral partly with outsole 11 and partly with insole 12, their tips being received in bores of the respective opposite sole member. FIG. 9 shows the studs all depending from insole 12 and engaging in stepped bores of outsole 11.

I CLAIM:

1. A shoe sole comprising an outsole member and an insole member of substantially identical outline, one of said members being provided along its periphery with a set of solid, substantially vertical studs having reduced tips surrounded by annular shoulders, the other of said members being provided along its periphery with a set of bores respectively aligned with said studs and penetrated by the tips thereof with said shoulders resting against said other of said members whereby said members are positively interconnected with formation of an air space therebetween, said insole member being provided inside a peripheral zone thereof with an array of venting apertures communicating with said air space and with a multiplicity of pins between said apertures extending toward said outsole member.

2. A shoe sole as defined in claim 1 wherein said pins have a length substantially equal to that of the exposed parts of said studs in the vicinity of the peripheral zone of said insole member and are of a lesser length on an area remote from said periperal zone so as to stand clear of said outsole member in an unloaded condition of said insole member.

3. A shoe sole as defined in claim 1 wherein said one of said members is further provided with flattened tubular peripheral formations interleaved with said studs and received in complementary slots of said other of said members, thereby forming channels for the passage of straps between said members.

4. A shoe sole as defined in claim 3 wherein said peripheral formations are stepped at the level of said annular shoulders to form additional abutments for said other of said members.

5. A shoe sole as defined in claim 4 wherein said one of said members is molded integral with said studs and peripheral formations.

6. A shoe sole as defined in claim 5 wherein said one of said members is said outsole member.

7. A shoe sole as defined in claims 1, 2, 3 or 6 wherein said bores are stepped and form small-diameter sections occupied by said tips and large-diameter sections occupied by adjoining unreduced parts of said studs.

* * * * *